US006230967B1

(12) United States Patent
Chung

(10) Patent No.: US 6,230,967 B1
(45) Date of Patent: May 15, 2001

(54) PAPER CONTAINER

(76) Inventor: Yu-Lin Chung, No.4 Lane 130, Nan-Kang Rd, Sec 3, Taipei (TW)

( * ) Notice: Subject to any disclaimer, the term of this patent is extended or adjusted under 35 U.S.C. 154(b) by 0 days.

(21) Appl. No.: 09/527,882

(22) Filed: Mar. 20, 2000

(51) Int. Cl.[7] ..... B65D 5/24

(52) U.S. Cl. ..... 229/171; 229/180; 229/186

(58) Field of Search ..... 229/171, 177, 229/179, 180, 186

(56) References Cited

U.S. PATENT DOCUMENTS

| | | | | |
|---|---|---|---|---|
| 2,373,730 | * | 4/1945 | Williamson et al. | 229/179 |
| 2,754,046 | * | 7/1956 | Roberts | 229/186 |
| 3,531,041 | * | 9/1970 | Rohde | 229/180 |
| 3,606,078 | * | 9/1971 | Phillips, Jr. | 229/171 |
| 3,913,823 | * | 10/1975 | Lin | 229/171 |
| 3,964,668 | * | 6/1976 | Lin | 229/171 |
| 4,148,429 | * | 4/1979 | Burr et al. | 229/186 |
| 4,291,826 | * | 9/1981 | Swanson | 229/180 |
| 4,648,549 | * | 3/1987 | Trutna | 229/177 |
| 4,846,398 | * | 7/1989 | Johnson | 229/171 |

* cited by examiner

*Primary Examiner*—Gary E. Elkins
(74) *Attorney, Agent, or Firm*—Pro-Techtor International Services

(57) ABSTRACT

A paper container is made of a paper blank on which folding lines are formed for dividing the paper blank into a central section and four side sections. The side sections intersect each other with two first triangular sections formed therebetween. A second triangular section is connected to each intersection and a third triangular section is connected to and symmetrical with respect to each second triangular section. A fourth triangular section is connected to each third triangular section. In forming the paper container, two opposite side sections and the first triangular sections are folded up first and the remaining side sections are folded up thereafter. The first triangular sections are then folded inward to overlap the corresponding side sections. The second sections and corresponding third triangular sections overlap each other and are folded down to overlap the first triangular sections. The fourth triangular sections are folded and inserted between the first triangular sections and the side sections to form and maintain the paper container. No staple or glue is needed in fixing and maintaining the paper container. The folding lines reinforce the structure of the paper container.

3 Claims, 5 Drawing Sheets

PAPER CONTAINER

FIELD OF THE INVENTION

The present invention generally relates to a paper container, and in particular to a paper container made by folding a single sheet of paper having folding lines for facilitating the folding operation and enhancing the structural strength thereof.

BACKGROUND OF THE INVENTION

Advertisement printed on paper is commonly seen. One may frequently receive a lot of advertisement mail. Such advertisement mails are usually disposed randomly. Some people may make paper containers out of the advertisement paper. FIG. 5 shows an example of a paper container A made of advertisement paper. The paper container A is made by folding a single sheet of paper several times in a predetermined sequence and thereafter fixed by staples or glue. Such a paper container has several disadvantages:

(1) It is difficult to make the container for a person having not practiced for a long time and thus skill is required in mating such containers efficiently.

(2) After the folding operation, staples B must be used to fix and maintain the container A. The stapler B may cause problem is recycling the paper container A.

(3) It takes times to make the paper containers.

(4) No folding lines are formed in the paper container A for reinforcing the structure thereof whereby the container A may easily collapse.

It is thus desirable to provide a paper container that overcomes the above problems.

SUMMARY OF THE INVENTION

Accordingly, an object of the present invention is to provide a paper container which may be made by folding a single sheet of paper, such as advertisement paper.

Another object of the present invention is to provide a paper container made of a sheet of paper on which folding lines are formed for facilitating the folding operation whereby the container may be made readily and efficiently.

A further object of the present invention is to provide a paper container made of a sheet of paper on which folding lines are formed for reinforcing the structure thereof whereby no staple or glue is needed in fixing and maintaining the container.

Yet a further object of the present invention is to provide a paper container made of a sheet of paper on which advertisement may be printed in advance so that when the container is formed, the advertisement is shown on the sides thereof.

To achieve the above objects, in accordance with the present invention, there is provided a paper container made of a paper blank on which folding lines are formed for dividing the paper blank into a central section and four side sections. The side sections intersect each other with two first triangular sections formed therebetween. A second triangular section is connected to each intersection and a third triangular section is connected to and symmetrical with respect to each second triangular section. A fourth triangular section is connected to each third triangular section. In forming the paper container, two opposite side sections and the first triangular sections are folded up first and the remaining side sections are folded up thereafter. The first triangular sections are then folded inward to overlap the corresponding side sections. The second sections and corresponding third triangular sections overlap each other and are folded down to overlap the first triangular sections. The fourth triangular sections are folded and inserted between the first triangular sections and the side sections to form and maintain the paper container. No staple or glue is needed in fixing and maintaining the paper container. The folding lines reinforce the structure of the paper container.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
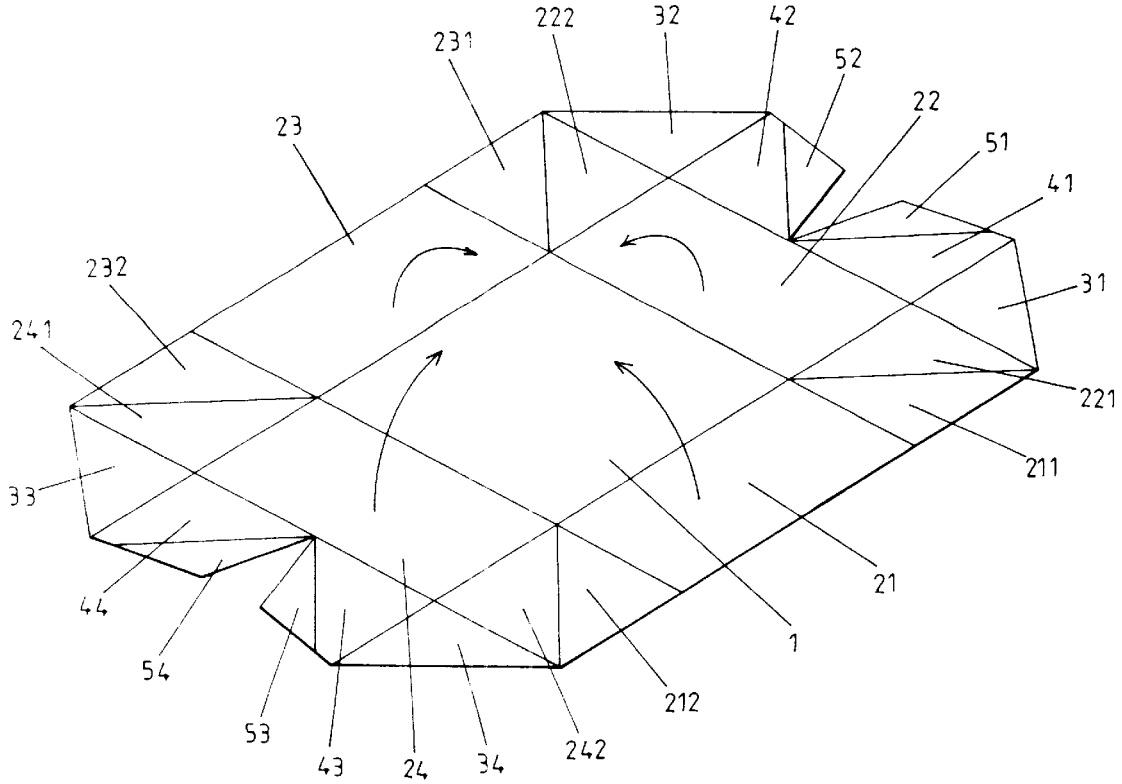
FIG. 1 shows a blank for making a paper container in accordance with the present invention.

With reference to the drawings and in particular to FIG. 1, wherein a paper blank for making a paper container in accordance with the present invention is shown, the paper blank comprises a single sheet of paper on which folding lines (not labeled) are formed for dividing the paper blank into a central section 1 and four side sections 21, 22, 23, 24 intersecting each other by means of two adjacent first triangular sections (211, 221), (222, 231), (232, 241), (242, 212) whereby each side section 21, 22, 23, 24 has two first triangular section 211, 212 or 221, 222 or 231, 232 or 241, 242 associated therewith and located at opposite ends thereof. A second triangular section 31, 32, 33, 34 is formed next to and connected to the first triangular 221, 222, 241, 242 and symmetric with respect thereto. A third triangular section 41, 42, 43, 44 are connected to each second triangular section 31, 32, 33, 34 and symmetric with respect thereto. A fourth triangular section 51, 52, 53, 54 is connected to each third triangular section 41, 42, 43, 44.

Figure 2:
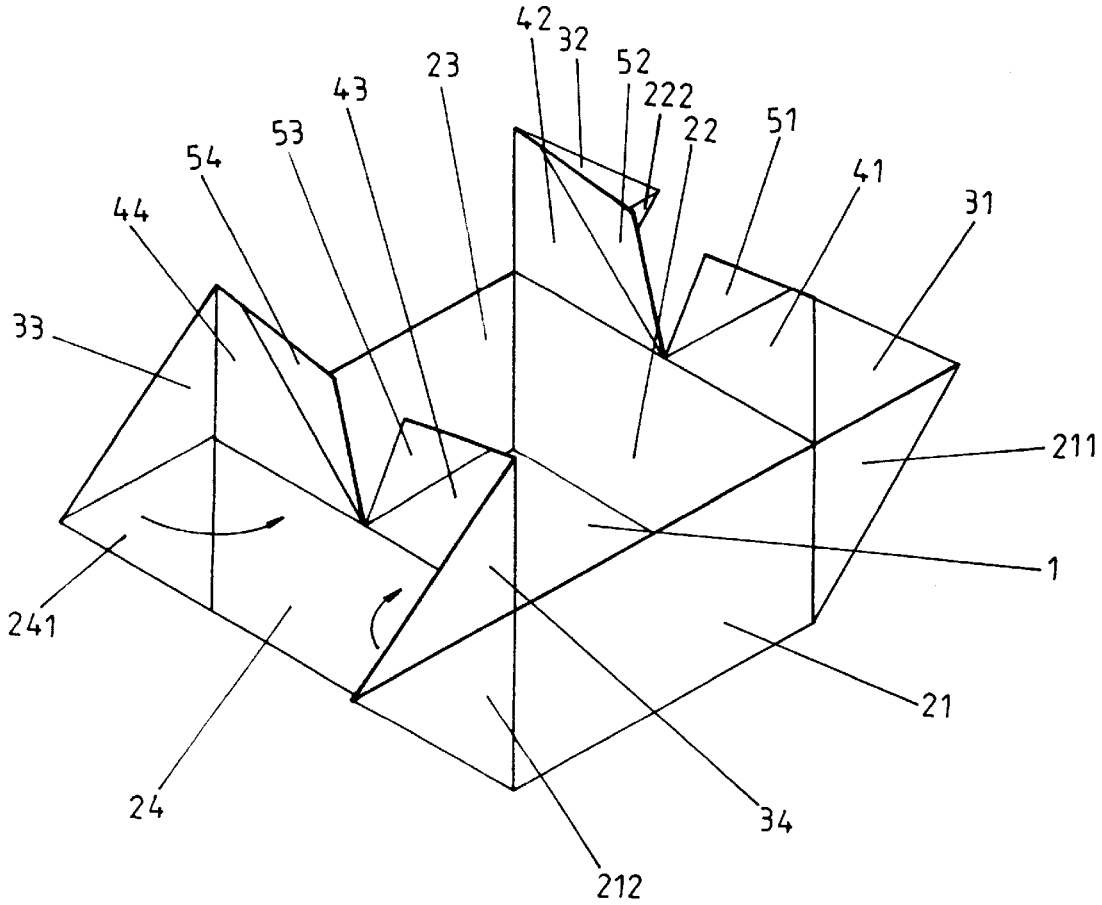
FIGS. 2–4 show the steps of folding the paper blank to form the paper container of the present invention.
Figure 3:
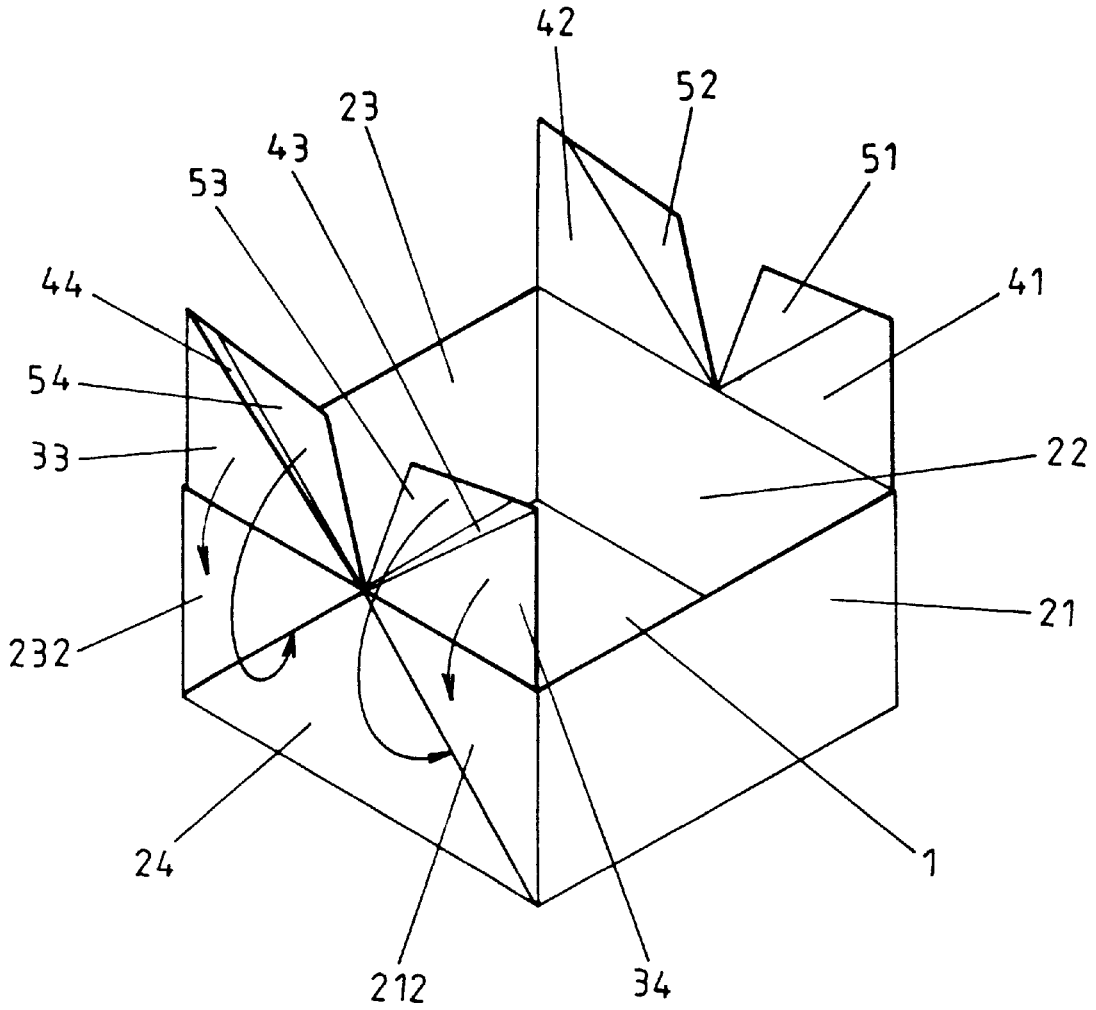
Figure 4:
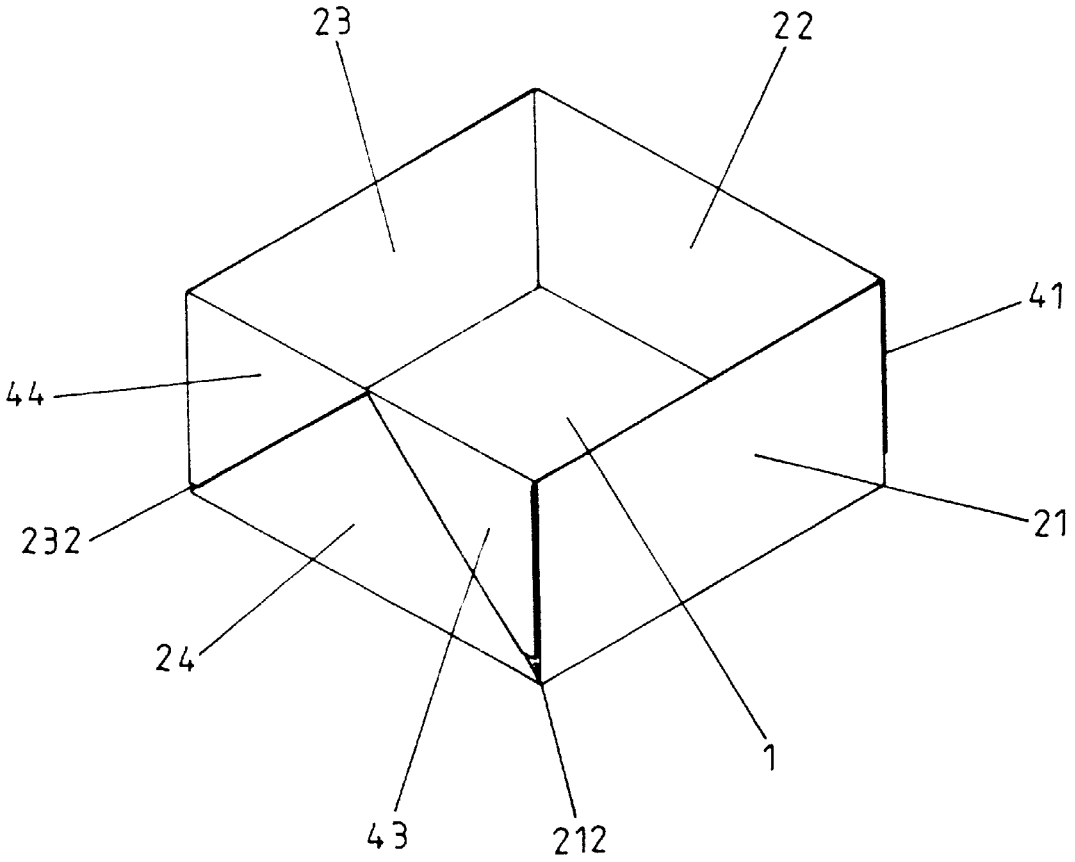
Figure 5:
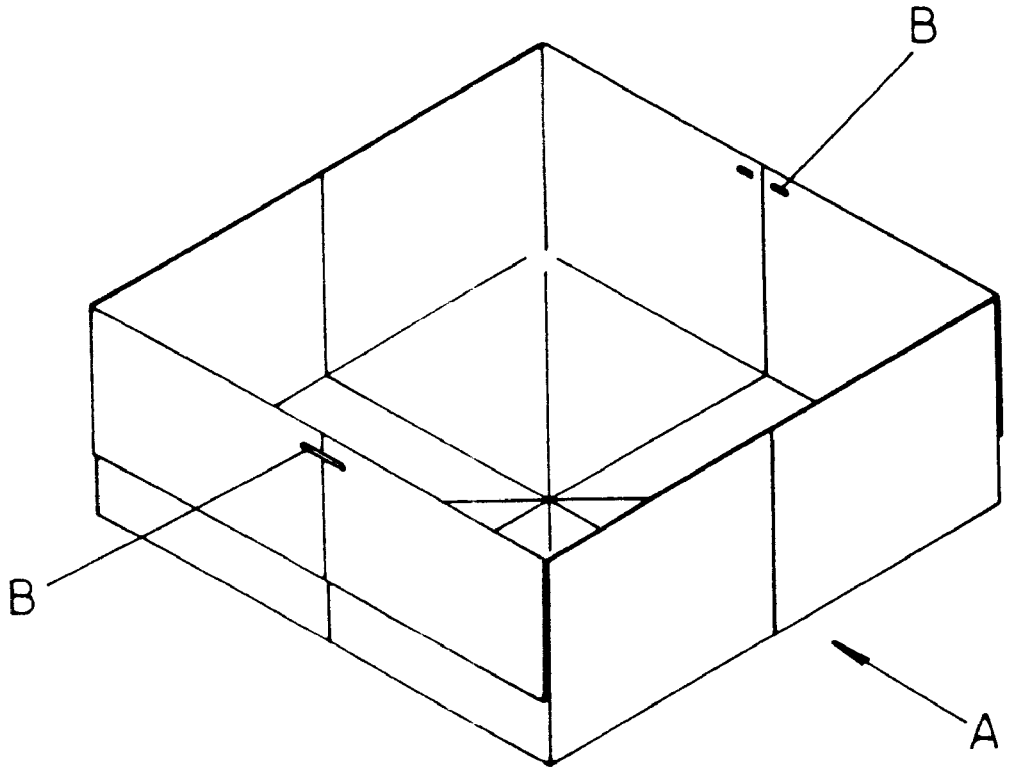
FIG. 5 shows a conventional paper container.

With reference to FIGS. 2–4, to fold the paper blank to form a paper container, the following steps are taken:

(1) The side sections 22, 24, together with the first triangular sections, are folded up first and then the side sections 21, 23 are folded up together with the first triangular sections thereof whereby the adjacent first triangular sections (211, 221), (212, 242), (231, 222), (232, 241) overlap each other.

(2) As shown in FIG. 2, the overlapping first triangular sections (211, 221), (212, 242), (231, 222), (232, 241) are folded inward to overlap the side sections 22, 24 with the triangular sections 211, 212, 231, 232 exposed. This makes the second triangular sections 31, 32, 33, 34 overlap the corresponding third triangular sections 41, 42, 43, 44.

(3) As shown in FIG. 3, the overlapping second and third triangular sections (31, 41), (32, 42), (33, 43), (34, 44) are folded down to overlap the exposed first triangular sections 211, 212, 231, 232.

(4) The fourth triangular sections 51, 52, 53, 54 are folded and inserted between the first triangular sections (211, 221), (212, 242), (231, 222), (232, 241) and the corresponding side sections 22, 24 for completing the container as shown in FIG. 4.

The paper container so formed has following advantages:

(1) It can be formed readily and efficiently by folding along the folding lines whereby no skill is required for making the paper container.

(2) No staple or glue is needed in fixing and maintaining the paper container.

(3) The paper container is reinforced by the folding lines formed on the paper blank.

(4) Since no rigid article, such as staple, is included in the paper container, recycling may be done easily and no damage may cause on people handling the recycled paper containers.

If desired, advertisement may be printed on the paper blank whereby when the paper container is formed by folding the paper blank, the advertisement may be shown on the sides thereof thereby providing a commercial application.

It is understood that although the paper container shown in the drawings and discussed herein is rectangular, other shapes, such as hexagon, octagon or circular may also be adopted.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A paper container made of a paper blank comprising a sheet of paper on which folding lines are formed for dividing the paper blank into a central section and four side sections, the side sections intersecting each other with two first triangular sections formed therebetween, a second triangular section connected to each intersection and a third triangular section connected to and symmetrical with respect to each second triangular section, a fourth triangular section connected to each third triangular section, wherein in forming the paper container, two opposite side sections and the first triangular sections are folded up first and the remaining side sections are folded up thereafter, the first triangular sections being then folded inward to overlap the corresponding side sections, the second and corresponding third triangular sections overlapping each other and being folded down to overlap the first triangular sections, the fourth triangular sections being folded and inserted between the first triangular sections and the side sections to form and maintain the paper container.

2. The paper container as claimed in claim 1, wherein advertisement is printed on the side sections.

3. The paper container as claimed in claim 1, wherein the paper container is hexagonal, octagonal or circular.

* * * * *